US010760345B2

(12) United States Patent
Roth et al.

(10) Patent No.: US 10,760,345 B2
(45) Date of Patent: Sep. 1, 2020

(54) CUTTING ELEMENTS WITH WEAR RESISTANT SURFACES

(71) Applicant: Smith International, Inc., Houston, TX (US)

(72) Inventors: Cary A. Roth, Spring, TX (US); Mingdong Cai, Houston, TX (US)

(73) Assignee: SMITH INTERNATIONAL, INC., Houston, TX (US)

( * ) Notice: Subject to any disclaimer, the term of this patent is extended or adjusted under 35 U.S.C. 154(b) by 84 days.

(21) Appl. No.: 16/002,051

(22) Filed: Jun. 7, 2018

(65) Prior Publication Data

US 2018/0283107 A1 Oct. 4, 2018

Related U.S. Application Data

(63) Continuation-in-part of application No. PCT/US2016/066053, filed on Dec. 12, 2016, and a (Continued)

(51) Int. Cl.
*E21B 10/567* (2006.01)
*C22C 29/08* (2006.01)

(Continued)

(52) U.S. Cl.
CPC ..... *E21B 10/5673* (2013.01); *B22F 1/02* (2013.01); *C22C 1/051* (2013.01); *C22C 29/08* (2013.01);

(Continued)

(58) Field of Classification Search
CPC ..... E21B 10/5673; E21B 10/52; E21B 10/55; B22F 1/02; B22F 5/00; B22F 7/06;

(Continued)

(56) References Cited

U.S. PATENT DOCUMENTS 3,301,645 A 1/1967 Smiley et al.
4,731,296 A 3/1988 Kikuchi et al.

(Continued)

FOREIGN PATENT DOCUMENTS

JP 3046336 B2 5/2000
JP 3707223 B2 10/2005

(Continued)

OTHER PUBLICATIONS

International Preliminary Report on Patentability issued in International Patent application PCT/US2016/066053, dated Jun. 21, 2018, 13 pages.

(Continued)

*Primary Examiner* — Yong-Suk Ro

(57) ABSTRACT

Cutting elements and hardfacing materials are in the form of a milled tooth having an uppermost first surface or crest and remaining surfaces such as flank surfaces and end surfaces extending downwardly away from crest. The crest has a hardfaced layer disposed thereon formed from a premium hardfacing material, and one or more of the remaining cutting element surfaces has a hardfaced layer formed from a hardfacing material different than the premium hardfacing material, wherein the hardfaced layer on the crest has a wear resistance at least 10% greater than that of the remaining cutting element hardfaced surfaces. The hardfaced layer on the crest may extend along a partial portion of one or more of the adjacent remaining cutting element surfaces.

20 Claims, 5 Drawing Sheets

Related U.S. Application Data continuation-in-part of application No. PCT/US2016/066054, filed on Dec. 12, 2016.

(60) Provisional application No. 62/266,485, filed on Dec. 11, 2015.

(51) Int. Cl.

| | |
|---|---|
| ***B22F 1/02*** | (2006.01) |
| ***C22C 1/05*** | (2006.01) |
| ***E21B 10/52*** | (2006.01) |
| *B22F 5/00* | (2006.01) |
| *B22F 7/06* | (2006.01) |
| *E21B 10/55* | (2006.01) |

(52) U.S. Cl.

CPC ..... *E21B 10/52* (2013.01); *B22F 5/00* (2013.01); *B22F 7/06* (2013.01); *B22F 2005/001* (2013.01); *B22F 2301/15* (2013.01); *B22F 2302/10* (2013.01); *B22F 2998/10* (2013.01); *B22F 2999/00* (2013.01); *E21B 10/55* (2013.01)

(58) Field of Classification Search

CPC ..... B22F 2005/001; B22F 2301/15; B22F 2998/10; B22F 2999/00; C22C 1/051; C22C 29/08

See application file for complete search history.

(56) References Cited

U.S. PATENT DOCUMENTS

| | | | | |
|---|---|---|---|---|
| 4,944,774 | A | 7/1990 | Keshavan et al. | |
| 5,152,194 | A * | 10/1992 | Keshavan | E21B 10/50 76/108.2 |
| 5,351,771 | A | 10/1994 | Zahradnik | |
| 5,492,186 | A | 2/1996 | Overstreet et al. | |
| 5,663,512 | A | 9/1997 | Schader et al. | |
| 5,921,330 | A | 7/1999 | Sue et al. | |
| 6,029,759 | A | 2/2000 | Sue et al. | |
| 6,170,583 | B1 | 1/2001 | Boyce | |
| 6,205,115 | B1 | 3/2001 | Ikebe et al. | |
| 6,207,262 | B1 | 3/2001 | Ichikawa et al. | |
| 6,248,149 | B1 | 6/2001 | Massey et al. | |
| 6,250,855 | B1 | 6/2001 | Persson et al. | |
| 6,360,832 | B1 | 3/2002 | Overstreet et al. | |
| 6,615,936 | B1 * | 9/2003 | Mourik | B23K 15/0086 175/374 |
| 6,641,918 | B1 | 11/2003 | Sherman et al. | |
| 6,923,276 | B2 * | 8/2005 | Overstreet | E21B 10/52 175/374 |
| 7,303,030 | B2 | 12/2007 | Lockwood et al. | |
| 7,654,346 | B2 | 2/2010 | Overstreet et al. | |
| 8,220,567 | B2 | 7/2012 | Scott et al. | |
| 8,225,890 | B2 | 7/2012 | Scott | |
| 8,322,466 | B2 | 12/2012 | Bird | |
| 9,103,004 | B2 * | 8/2015 | MacLeod | C22C 26/00 |
| 9,353,578 | B2 | 5/2016 | Xia et al. | |
| 2008/0017421 | A1 | 1/2008 | Lockwood | |
| 2008/0282618 | A1 | 11/2008 | Lockwood | |
| 2010/0122853 | A1 | 5/2010 | Scott et al. | |
| 2014/0262542 | A1 | 9/2014 | Cai et al. | |

FOREIGN PATENT DOCUMENTS

| | | | |
|---|---|---|---|
| JP | 3887811 | B2 | 2/2007 |
| SE | 529052 | C2 | 4/2007 |
| WO | 2006001791 | A1 | 4/2007 |
| WO | 2011017318 | A1 | 2/2011 |

OTHER PUBLICATIONS

International Preliminary Report on Patentability issued in International Patent application PCT/US2016/066054, dated Jun. 21, 2018, 14 pages.

International Search Report and Written Opinion issued in International Patent Application No. PCT/US2016/066053 dated Mar. 24, 2017, 16 pages.

International Search Report and Written Opinion issued in International Patent Patent Application No. PCT/US2016/066054 dated Mar. 24, 2017, 17 pages.

Lassner et al., Tungsten in Hardmetals, in Tungsten, Kluwer Academic, Plenum Publishers, NY, 1999, pp. 321-363.

Caraway et al., Cutting Edge Materials Technology Elevates Drilling Performance in Soft Formation Applications, Society of Petroleum Engineers, SPE-93856-MS, SPE Asia Pacific Oil and Gas Conference and Exhibition: Jakarta, Indonesia. Apr. 5-7, 2005. 12 pages.

Casteletti, L.C., Effect of the HVOF Deposition Process in the Chemical Composition of Tungsten Carbide Layers with Cobalt or Nickel Binders, Journal of ASTM International; 7(3), Jan. 2010.

* cited by examiner

CUTTING ELEMENTS WITH WEAR RESISTANT SURFACES

CROSS-REFERENCE TO RELATED APPLICATIONS

This application is a continuation-in-part of International Patent Application No. PCT/US2016/066054, filed Dec. 12, 2016, which claims priority to, and the benefit of, U.S. Patent Application No. 62/266,485, filed Dec. 11, 2015. This application is also a continuation-in-part of International Patent Application No. PCT/US2016/066053, filed Dec. 12, 2016, which claims priority to, and the benefit of, U.S. Patent Application No. 62/266,485, filed Dec. 11, 2015. Each of the foregoing applications is expressly incorporated herein by this reference in its entirety.

BACKGROUND

Drill bits used for subterranean drilling, such as those used for drilling oil wells and the like, commonly have a steel body that is connected at the bottom of a drill string. An example such drill bits includes roller cone bits, which have a bit body and one or more roller cones rotatably mounted to the bit body. The bit body is typically formed of steel or another high strength material, and includes cutting elements at selected positions about the cones. The cones and cutting elements rotate and engage with the bottom of a hole being drilled to crush, gouge, and scrape rock for drilling the well. One type of roller cone bit, referred to as a "milled tooth" bit, has roughly trapezoidal teeth protruding from the surface of the cone for engaging the rock, and the teeth are formed of the same material as the cone. The principal faces of such milled teeth that engage the rock are usually hardfaced with a layer of material that is designed to resist wear and/or fracture.

The term "hardfaced" is understood in industry to refer to the process of applying a carbide-containing steel material (e.g., hardfacing) to the underlying steel substrate by welding process, as is described in more detail herein. Thus, the terms "hardfaced layer" or "hardfacing" are understood as referring to the layer of hardmetal that is welded onto the underlying steel substrate.

Conventional hardmetal materials used to provide wear resistance to the underlying steel substrate usually comprises pellets or particles of cemented tungsten carbide (WC—Co) and/or cast carbide particles that are embedded or suspended within a steel matrix. The carbide materials are used to impart properties of wear resistance to the steel matrix. Conventional hardmetal materials useful for forming a hardfaced layer on bits may also include iron-based steel and nickel-based high strength alloys to provide one or more certain desired physical properties. In some cases, carbide or other hard particles may be a phase that exhibits relatively high hardness for wear resistance purposes, while steel or other matrix materials act as another phase providing relatively high strength and fracture toughness.

The hardfaced layer is applied to the milled teeth by oxyacetylene or atomic hydrogen welding. The hardfacing process makes use of a welding "rod" or stick that is formed of a tube of mild steel sheet enclosing a filler which is made up of primarily carbide particles. The filler may also include deoxidizer for the steel, flux, and resin binder. The relatively wear resistant filler material is typically applied to the underlying steel tooth surface, and the underlying tooth surface is thus hardfaced, by melting an end of the rod on the face of the tooth. The steel tube melts to weld to the steel tooth and provide the matrix for the carbide particles in the tube.

SUMMARY

Cutting elements and hardfacing materials as disclosed herein may be used with bits for drilling subterranean formations and the like. Such cutting elements may be in the form of a milled tooth or the like, have a first surface or crest disposed along an uppermost portion of the cutting element, and have remaining surfaces in the form of flank surfaces and end surfaces perpendicular to the flank surfaces and extending downwardly away from the first surface towards a base of the cutting element. In an example, the first surface comprises a hardfaced layer disposed thereon formed from a premium hardfacing material having an improved degree of wear resistance when compared to conventional hardfacing materials. In an example such premium hardfacing material may have a wear resistance that is at least 10% greater than remaining cutting element surfaces having a hardfaced layer disposed thereon that is formed from a different hardfacing material, i.e., one other than the premium hardfacing material. In an example, one or more of the remaining surfaces of the cutting element may comprise such hardfaced layer formed from the different hardfacing material having the reduced wear resistance, e.g., wherein such hardfaced remaining surfaces may comprise one or both of the flanks surfaces and/or one or both of the end surfaces. In an example, a partial portion or region of the remaining surfaces adjacent the first surface or crest may include the hardfaced layer of the first surface. In an example, the thickness of the hardfaced layer on the first surface or crest may be the same or greater than that of the hardfaced layer formed from the different hardfacing material disposed on the remaining surfaces of the cutting element.

In an example, the premium hardfacing material used to form the hardfacing layer on the first surface may comprise a plurality of hard material phases dispersed in a continuous metallic alloy binder phase, wherein the hard material phase comprises sintered WC—Co pellets. The continuous metallic alloy binder phase may comprise an iron-or nickel-based metal. A thermally stable material layer encapsulates the pellets and is interposed between and in contact with both the pellets and the continuous metallic alloy binder phase. In an example, the thermally stable material layer is formed from a material selected from the group consisting of refractory metals, carbides of refractory metals, and combinations thereof.

Hardfacing material compositions as disclosed herein include a plurality of hard material phases dispersed in a continuous metallic alloy binder phase, wherein the hard material phase includes sintered WC—Co pellets. In an example, the continuous metallic alloy binder phase may include an iron-or nickel-based metal or alloy. A feature of such hardfacing composition is that the pellets are encapsulated by a thermally stable material layer that is interposed between and in contact with both the pellets and the continuous metallic alloy binder phase. In an example, the thermally stable material layer is formed from a material selected from a material having a melting point that exceeds the application temperature of the hardfacing, e.g., that has a melting temperature of greater than about 1,650° C., and greater than about 1,700° C.

Materials useful as the thermally stable layer may include refractory metals, carbides of refractory metals, and combinations thereof. Suitable refractory metals include Ti, V, Cr, Zr, Nb, Mo, Ru, Rh, Hf, Ta, W, Re, Os and Ir, and suitable carbides of refractory metals include Ti, V, Cr, Zr, Nb, Mo, Ru, Rh, Hf, Ta, W, Re, Os and Ir. In an example, the thermally stable material layer includes W. The thermally stable material layer may have a thickness that is between about 2% to 4% of the pellet diameter, or have a thickness of from 2 to 80 microns.

The hardfacing composition hard material phase includes other carbide materials in addition to the sintered WC—Co pellets, where such other carbide materials may or may not be encapsulate with the thermally stable material layer. In an example, the other carbide material may be spherical cast carbide. In an example, the hard material phase comprises from 55 to 90 percent by weight (wt %) pellets and from about 10 to 45 wt % of the other carbide materials based on the total weight of the pellets and the carbide materials. In an example, the hardfacing material composition includes about 55 to 80 wt % hard material phases and about 20 to 45 wt % metallic binder alloy phase based on the total weight of the hardfacing composition.

This summary is provided to introduce a selection of concepts that are further described below in the detailed description. This summary is not intended to identify key or essential features of the claimed subject matter, nor is it intended to be used as an aid in limiting the scope of the claimed subject matter.

BRIEF DESCRIPTION OF THE DRAWINGS

These and other aspects and features of cutting element constructions as disclosed herein and methods of making or using the same as disclosed herein will be appreciated as the same becomes better understood by reference to the following detailed description when considered in connection with the accompanying drawings, in which.

DESCRIPTION

Figure 1:
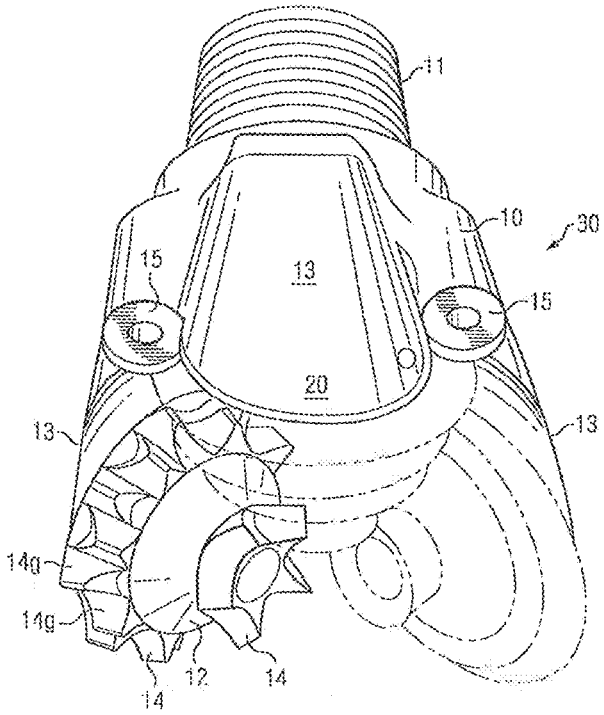
FIG. 1 is a perspective view of a roller cone drill bit as used with cutter element constructions as disclosed herein.

In accordance with some embodiments, the present disclosure relates to cutting elements. For instance, cutting elements disclosed herein may include improved wear-resistant surface compositions and, more particularly, improved wear-resistant hardfacing compositions as applied to wear surfaces of cutting elements that may be used on bits for subterranean drilling or the like.

Example hardfacing surfaces may be formed from hardfacing. Hardfacing material constructions disclosed herein include a plurality of hard material phases that include hard materials in the form of relatively large sintered particles or pellets, according to embodiments described in greater detail herein. Such hard material pellets are encapsulated by a layer of thermally stable material, and are combined with other hard material phases. The hard material pellets are dispersed within a continuous metallic binder alloy phase or matrix. In some embodiments, the thermally stable material layer or shell encapsulating the hard material pellet operates to provide a thermal barrier that protects the hard material pellet against constituents of the metallic binder alloy phase infiltrating into the hard material pellet during application of the hardfacing material composition while also protecting the metallic binder alloy phase from constituents of the hard material diffusing out of the pellet (i.e., it protects the pellet from unwanted interdiffusion that can operate to reduce the desired hardness and wear resistant properties of the hardfacing material).

Hardfacing material compositions or hardfacing as disclosed in embodiments herein, include a hard phase of sintered hard phase pellets and additional hard materials. The hard phase, when applied onto a desired metallic substrate surface such as one on a downhole tool such as a drill bit, is dispersed in a metallic binder alloy phase or matrix to provide an enhanced degree of hardness and wear resistance to the tool.

Cutting elements and hardfacing materials used in conjunction therewith as disclosed are provided in a manner that is calculated to provide an optimized degree of wear resistance along the portion(s) of the cutting element where it is needed most. Conventional hardfaced steel teeth used in rock bits for subterranean drilling are known to suffer a higher degree of wear-related loss of the hardfaced surface along the crest portion of the tooth as contrasted with other surfaces. Thus, the service life of the bit comprising the same largely depends on the run time that can be provided before the hardfacing along the crest is removed. Thus, cutting elements as disclosed herein are specially developed to have a certain premium type of hardfacing material disposed along such surfaces of the cutting element known to have a relatively higher wear rate, and also comprise another type of hardfacing (having lower wear properties than the premium type of hardfacing) disclosed along other parts of the cutting element having a relatively lower wear rate.

While cutting element and hardfacing materials used in conjunction therewith as disclosed herein will be described in the context of steel milled teeth used in association with rotary cone bits or rock bits, it is to be understood that cutting elements and hardfacing materials used in conjunction therewith as disclosed herein may be used with cutting elements other than steel milled teeth, and be used in conjunction with other types of devices that may include other types of bits or the like that may or may not be used for subterranean drilling applications.

FIG. 1 illustrates an example downhole tool in the form of a milled tooth roller cone bit, which is generally referenced as rock bit 30. The rock bit 30 includes a body 10 having a threaded coupling or pin 11 at one end for connection to a conventional drill string. At the opposite end of the body 10 there is a cutting structure including three roller cones 12 for drilling rock for forming a wellbore for an oil well or the like. Each roller cone 12 is rotatably mounted on a journal or pin extending diagonally inwardly on one of three legs 13 extending downwardly from the body 10 of the rock bit 30. Each bit leg 13 has a shirttale region 20. As the rock bit 30 is rotated by the drill string, the roller cones 12 effectively roll on the bottom of the wellbore being drilled.

The cones 12 are shaped and mounted so that as they roll, teeth 14 on the cones 12 gouge, chip, crush, abrade, and/or erode the rock at the bottom of the wellbore. The teeth 14*g* in the row around the heel of the cone 12 are referred to as the gage row teeth. They engage the bottom of the hole being drilled near its perimeter or "gage." Fluid nozzles 15 direct drilling fluid or "mud" into the hole to carry away the particles of rock created by the drilling.

Such a rock bit is conventional and is therefore merely one example of various arrangements that may be used in a drill bit including hardfacing material compositions as disclosed herein. For example, most roller cone bits are of the three cone variety; however, one, two, and four cone roller cone bits are also known. The arrangement of teeth on the cones is just one of many possible variations. Therefore, the number of such roller cones on a drill bit is not intended to be a limitation on the scope of the present disclosure. In fact, it is typical that the teeth 14 on the cones 12 on a rock bit 30 differ from each other so that different portions of the bottom of the hole are engaged by each of the three roller cones so that collectively the entire bottom of the hole is drilled. A broad variety of tooth and cone geometries are known and do not form a specific part of this invention.

Figure 2:
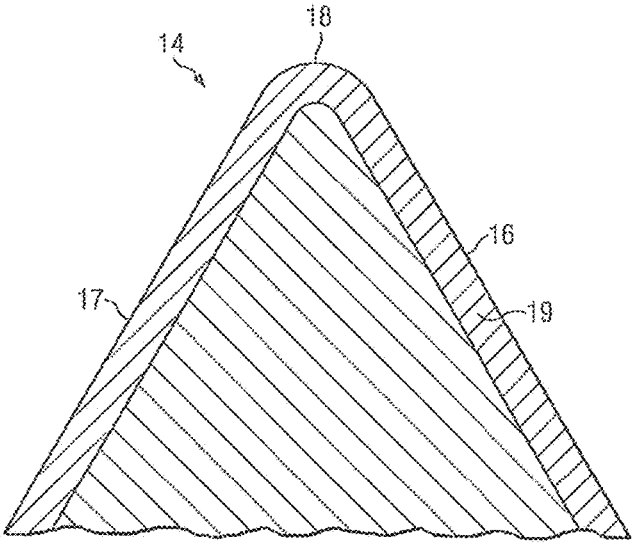
FIG. 2 is a cross-sectional side view of a conventional steel tooth bit comprising a conventional hardfacing material.

FIG. 2 illustrates prior art milled tooth 14 having a generally triangular or trapezoidal cross section when taken from a radial plane of the cone. Such a tooth has a leading flank 16 and a trailing flank 17 meeting in an elongated crest 18 that runs along a top surface of the tooth between inner and outer axial ends (not shown). The flanks and the crest portions of the teeth are covered with a hardfaced layer 19 formed from a conventional hardfacing material, and the thickness of the hardfaced layer may be approximately the same along each of the surfaces.

The leading face of the tooth 14 is the face that tends to bear against the undrilled rock as the rock bit is rotated in the hole (and to keep the tooth relatively sharp for enhanced penetration of the rock). Because of the various cone angles of teeth on a roller cone relative to the angle of the pin on which the cone is mounted, the leading flank on the teeth in one row on the same cone may face in the direction of rotation of the bit, whereas the leading flank on teeth in another row may, on the same cone, face away from the direction of rotation of the bit. In other cases, particularly near the axis of the bit, neither flank can be uniformly regarded as the leading flank and both flanks may be provided with a hardfaced layer.

There are also times when the inner and outer axial ends of a tooth, that is, the portions facing in more or less an axial direction on the cone, are also provided with a hardfaced layer. This is particularly true on the so-called gage row or surface of the bit routinely is provided with hardfaced layer. The gage surface is a generally conical surface at the heel of a cone which engages the side wall of a hole as the bit is used. The gage surface includes the outer end of teeth 14*g* (FIG. 1) in the so-called gage row of teeth nearest the heel of the cone and may include additional area nearer the axis of the cone than the root between the teeth. The gage surface is not considered to include the leading and trailing flanks of the gage row teeth. The gage surface encounters the side wall of the hole in a complex scraping motion which induces wear of the gage surface. In some embodiments, the hardfaced layer may also be applied on the shirttail 20 (see FIG. 1) at the bottom of each leg 13 on the bit body 10.

The basic structure of a milled tooth rock bit is well known and does not form a specific portion of the cutting elements and wear resistance disposed thereon disclosed herein, which relates to cutting elements specially developed having a composite construction of different types of hardfacing materials disposed on different surfaces of the cutting element to provide an level of optimum wear performance so as to extend the service life of a bit comprising the same.

Generally speaking, for the effective use of a rock bit, it is important to provide as much wear resistance as possible on the teeth of a rock bit roller cone. The effective life of the cone is enhanced as wear resistance is increased. It is desirable to keep the teeth protruding as far as possible from the body of the cone since the rate of penetration of the bit into the rock formation is enhanced by longer teeth (however, unlimited length is infeasible since teeth may break if too long for a given rock formation). As wear occurs on the teeth, they get shorter and the drill bit may be replaced when the rate of penetration decreases to an unacceptable level. It is, therefore, desirable to minimize wear so that the footage drilled by each bit is maximized. This not only decreases direct cost, but also decreases the frequency of having to "round trip" a drill string to replace a worn bit with a new one.

Due to the unique wear encountered along the crest portion of the milled teeth relative to the other teeth surfaces, it is desired that a composite of different types of hardfacing material be used on different surface portions of the tooth to provide an optimal degree of wear performance such that one surface does not wear sooner than another. As disclosed herein, such different types of hardfacing material may be used to cover all surfaces of the tooth, or only selected surfaces of the tooth depending on the particular end-use application. The use of such different hardfacing material may be used in providing the optimal degree of wear performance and related abrasion protection for gage teeth and/or for other non-gage teeth as well. As gage teeth and gage surfaces wear, the diameter of the hole drilled by the bit may decrease, sometimes causing drilling problems or requiring "reaming" of the hole by the next bit used. Advances in wear resistance of the cone and/or teeth wear surfaces is desirable to increase the duration during which a hole diameter (or gage) can be maintained, to enhance the footage a drill bit can drill before becoming dull, and to enhance the rate of penetration of such drill bits. Such improvements translate directly into reduction of drilling expense.

Rock bits comprising the composite hardfaced surfaces as disclosed herein, provide improved properties of wear resistance to those surfaces of the rock bit, e.g., the teeth on the roller cones, and more specifically the crest surface of the teeth, subjected to the most extreme wear conditions, thereby reducing material loss and providing for an optimal degree of wear performance that operates to extend the effective service life of rock bits comprising the same.

Figure 3:
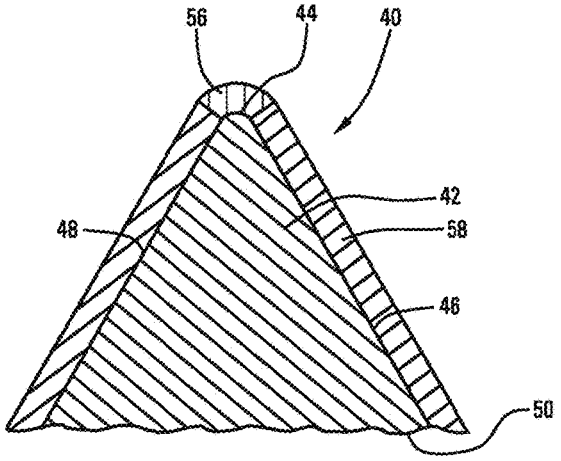
FIG. 3 is a cross-sectional side view of an example cutting element as disclosed herein.
Figure 4:
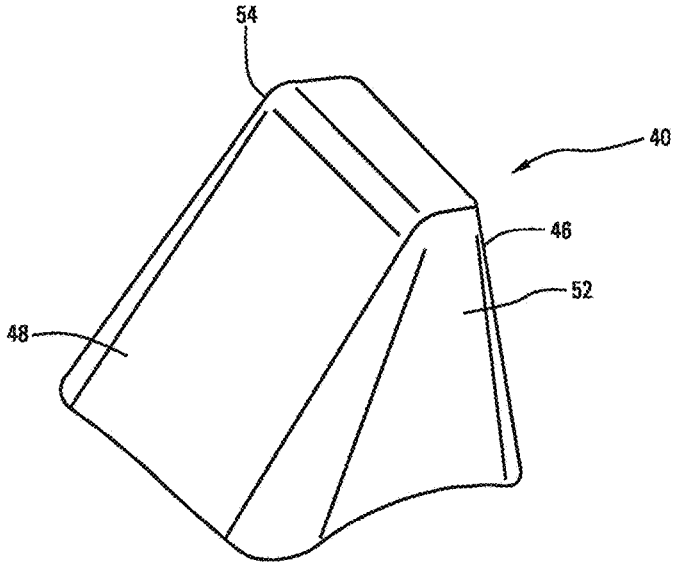
FIG. 4 is a perspective view of the example cutting element of FIG. 3.

FIGS. 3 and 4 illustrate an example cutting element 40 as in the form of steel milled tooth comprising the composite hardfaced surfaces as disclosed herein. The tooth 40 comprises a steel body 42 having a crest surface 44 extending along an uppermost portion of the body, and having first and second flank surfaces 46 and 48 extending from opposed edges of the crest surface downwardly towards a base 50 of the tooth. Thus, the crest surface 44 is positioned at the intersection of the first and second flank surfaces 46 and 48. FIG. 4 illustrates a view of the tooth 40 illustrating a first and second axial end surface 52 and 54 that are opposed from one another, and that extend between each of the first and second flanks surfaces 46 and 48.

In an example, it is desired that the tooth crest surface 44 comprise a hardfaced layer 56 disposed thereon formed from a premium hardfacing material having an increased degree of wear resistance as compared with other or different hardfacing materials that may be disposed on one or more other surfaces of the tooth. In an example, such premium hardfacing materials may include materials comprising a higher wt % of carbide or cemented tungsten carbide than the other or different hardfacing materials, which may be in greater than about 10 wt % carbide or tungsten carbide, in the range of from about 25 to 100 wt % carbide or tungsten carbide, and in the range of from about 50 to 100 wt % by volume carbide or tungsten carbide. In an example embodiment, the premium hardfacing material has a carbide or cemented tungsten carbide content of approximately 65 wt %.

In an example, it is desired that the premium hardfacing material functionally operate to provide a hardfaced layer having an increased level or degree of wear resistance as contrasted to the wear resistance of a hardfaced layer or surface made from another or different hardfacing material. In an example, it is desired that the premium hardfacing material provide a hardfaced layer or surface 56 having a wear resistance (determined by wear number as described below) that is at least 10%, from about 25% to 50%, and from about 30% to 40% greater than the wear resistance provided by a hardfaced surface formed from another or different hardfacing material ( ). The reduced wear resistance of the other or different hardfacing material may be a function of a reduced amount and/or type of carbide or cemented tungsten carbide, and/or a function of the type of binder material that is used. In such example, the wear resistance was determined by conducting a high stress wear test in accordance with ASTM B611, and the test results provided a wear number, and the wear number was compared against that for another or different hardfacing material and the percent difference noted above was determined.

In another example, the premium hardfacing material may be provided in the form of a carbide or tungsten carbide material that has been specially engineered to have improved properties of heat resistance for purposes of reducing or eliminating breakdown of sintered carbide pellets into the surrounding matrix during the process of applying the hardfacing and during use. An example of such material is one comprising a plurality of hard material phases that includes hard materials in the form of relatively large sintered particles or pellets, as described in greater detail below. Such hard material pellets are encapsulated by a layer of thermally stable material, and are combined with other hard materials in the hard material phase, and the plurality of hard material phases are dispersed within a continuous metallic binder alloy phase or matrix. The thermally stable material layer or shell encapsulating the hard material pellet operates to provide a thermal barrier that protects the hard material pellet against both constituents of the hard material diffusing into the metallic binder alloy phase, and to protect against constituents of the metallic binder alloy phase infiltrating into the hard material pellet during application of the hardfacing material composition, i.e., it protects the pellet from unwanted interdiffusion that can operate to reduce the desired hardness and wear resistant properties of the hardfacing material.

Hardfacing material compositions or hardfacing as disclosed herein comprise a hard phase made up of sintered hard phase pellets and additional hard materials, wherein the hard phase, when applied onto a desired metallic substrate surface such as one on a downhole tool such as a drill bit and/or cutting elements used therewith, is dispersed in a metallic binder alloy phase or matrix to provide an enhanced degree of hardness and wear resistance to specific surface of the tool upon which the premium hardfacing material is applied.

Hardfacing material compositions as disclosed herein comprise a hard phase that includes relatively large-sized hard materials in the form of sintered particles or pellets. In an example, the large-sized hard materials are sintered pellets comprising tungsten carbide. For example, the large-sized hard materials may include tungsten carbide in the form of WC or W2C, or in the form of WC—Co (cobalt-cemented tungsten carbide), or may include WC—Ni (nickel-cemented tungsten carbide), titanium carbides or cemented titanium carbides (e.g., TiC—Co and/or TiC—Ni), borides such as tungsten borides, titanium borides, and ternary boride cermet. Ternary boride cermet materials useful for forming the sinter particles or pellet as used with hardfacing material compositions disclosed herein include those disclosed in US Published Patent Application No. 2014/0262542, which application is herein incorporated by reference in its entirety. The hard material pellets may be formed and sintered by conventional process known in the art. In an example, sintered cemented tungsten carbide (WC—Co) comprises small particles of tungsten carbide (e.g., 1 to 15 microns) bonded together with the metal binder cobalt (e.g., about 6 wt %). Sintered cemented tungsten carbide may be produced by mixing an organic wax, mono-tungsten carbide, and the metal binder. The mixture is pressed or pelletized to form a green compact, and the green compact is sintered at temperatures near the melting point of the metal binder. In some cases, the resulting sintered compact is comminuted to form pellets of the desired particle size and shape. In an example, the resultant hard material pellets may be spherical in shape to provide a uniform stress concentration along the entire surface of the pellet, thereby operating to provide an enhanced degree of impact resistance.

In an example, the hard material pellets may be sized to provide a desired degree of wear resistance in the hardfacing as called for by a particular end-use application. In an example where the end use application of the hardfacing is to provide a protective surface on a milled tooth of a drill, the hard material pellets may have a particle diameter of greater than about 40 microns, from about 100 to 2,000 microns, and preferably from about 80 to 1,200 microns.

It is to be understood that premium hardfacing material compositions as disclosed herein may include hard material pellets having a monomodal particle size distribution, or having a bimodal or multimodal particle size distribution. For instance, premium hardfacing material compositions of the present disclosure may include a combination of hard material pellets having different average particle diameters, with such particle diameters being within at least one of the ranges provided herein. For example, for use in a particular hardfacing embodiment, it may be desired to use hard material pellets having a multimodal particle size distribution of two average particle sizes. Such an example may include pellets having a first particle size distribution of characterized as 16/20, wherein 16/20 refers to US mesh size, and wherein pellets in this distribution have a particle diameter that passes through 16 mesh but not 20 mesh (i.e., pellets having a particle size of greater than about 840 microns up to about 1,190 microns); and having a second particle size distribution of hard material pellets characterized as 30/40, wherein 30/40 refers to US mesh size, and wherein pellets in this distribution have a particle diameter that passes through 30 mesh but not 40 mesh (i.e., pellets having a size of greater than about 400 microns up to about 595 microns).

As used herein, the term "mesh" refers to the size of the wire mesh used to screen the carbide particles. For example, "40 mesh" indicates a wire mesh screen with forty holes per linear inch, where the holes are defined by the crisscrossing strands of wire in the mesh. The hole size is determined by the number of meshes per inch and the wire size. The mesh sizes referred to herein are U.S. Standard Sieve Series mesh sizes, also described as ASTM E11.

It is to be understood that the above is just one example of a hard material pellet multimodal size distributions that may be used to make premium hardfacing material compositions as disclosed herein, and that such particle size distributions can and will vary depending on such factors as the type of material used to form the pellets, the particular end-use application, and the types/sizes of other materials used to make hardfacing material compositions as disclosed herein. Further, the particular amount or proportion of the differently-sized hard material pellets will also have an impact on the desired end use properties, such as hardness, wear resistance and toughness, of the hardfacing material containing the same.

For example, for the bimodal pellet size example provided above, for a particular end-use application, it may be desired to use a larger amount of the 16/20 pellets than the 30/40 hard material pellets. In such an example, the increased amount of the of the larger-sized hard material pellets relative to the small-sized hard material pellets may operate to provide an increased degree of hardness and wear resistance, while also providing a desired packing density for the hard material pellets operating to thereby to improve the overall density or volume of the hard material pellets in the hard phase of the hardfacing material composition.

In an example, the hard material pellets comprise a desired weight percent of the total hard material phase. In an example, the total amount of the pellets (whether having a monomodal or multimodal size distribution) comprise a majority, i.e., greater than 50% of the total weight of the hard material phase. In an example, the pellets comprise between about 55 to 90 wt %, 65 to 80 wt %, and preferably 70 to 75 wt % of the total weight of the hard material phases.

It is to be understood that the exact amount of the pellets that are used to make up the hard material phase will vary depending on a variety of factors. In a particular example, comprising pellets having the bimodal size distribution noted above, the total amount of the pellets are approximately 70 wt % of the of the hard material phase, wherein the pellets having the 16/20 mesh size distribution make up approximately 42 wt % of the total weight of the hard material phase, and the pellets having the 30/40 mesh size distribution make up approximately 29 wt % of the total weight of the hard material phase.

As noted above, a feature of premium hardfacing material compositions as disclosed herein is that such hard material pellets are coated or encapsulated with a thermally stable material. The thermally stable material is formed from materials capable of preventing both the unwanted diffusion of constituents within the hard material pellets, e.g., cobalt or the like, into the metallic binder alloy phase, and to prevent constituents of the metallic binder alloy phase from diffusing or infiltrating into the hard material pellets when exposed to high temperatures used for applying the hardfacing material composition onto a desired metallic surface and/or during use of the device upon which the hardfacing material composition is disposed thereon.

It has been discovered with conventional hardfacing materials that during application of the hardfacing by conventional high-temperature application methods, such as by oxyacetylene welding or the like, that binder materials in the metallic binder alloy phase—such as iron and the like—diffuse into the hard materials such as tungsten carbide, which diffusion operates to produce an eta phase along the outer perimeter of the hard material pellet and/or dispersed throughout the surrounding metallic binder alloy network. Such eta phase is brittle and operates to embrittle the hard materials as well as the continuous metallic binder alloy network or phase making it vulnerable to cracking and failure during use and/or during heat cycles associated with repairs. Accordingly, the formation and presence of such eta phase operates to embrittle the metallic binder alloy, thereby reducing the desired combination of hardness and toughness in conventional hardfacing material. For this reason, such conventional hardfacing materials are vulnerable to premature breakage and failure that reduces the effective service life of the associated equipment upon which the conventional hardfacing material is applied to protect.

Figure 5:
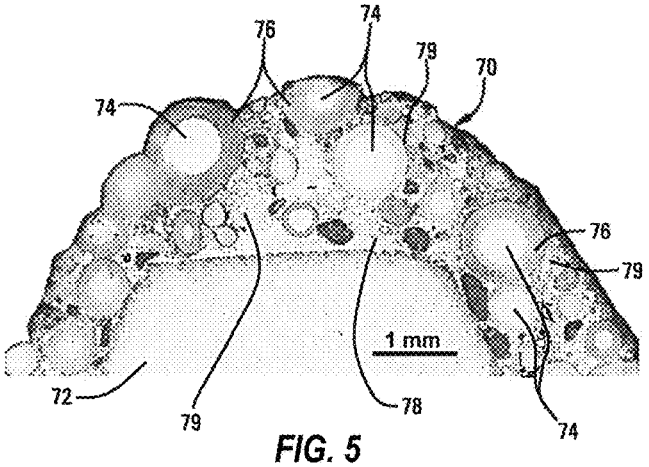
FIG. 5 is a photomicrograph image of a conventional hardfacing material disposed on a metallic cutting element.

FIG. 5 is a photomicrograph illustrating a hardfacing layer 70 disposed on a milled tooth 72 of a drill bit (such as that illustrated in FIG. 2). The hardfacing layer 70 comprises sintered carbide pellets 74 that are not encapsulated to include a thermal barrier and that are shown to include a heat affected zone 76 that appears as a darkened zone surrounding the an outside region of the pellets 74 where the sintered full dense WC—Co structure is getting loose, cobalt diffuses out into the metallic binder alloy and iron from the alloy diffuses in. The formation of the heat affected zone 76 operates to both reduce the effective size and adversely impacts resulting properties of the pellets, e.g., the carbide pellets now have a reduced content of WC operating to reduce the hardness of the pellets in the hardfacing material. Additionally, when the dissolved carbide material, e.g., WC, from the pellets meets iron and Co diffusing from the metallic binder this combines to form an eta phase 79. In most instances, the eta phase 79 is formed and exists in a region along an outside edge of the pellet 74 in the metallic binder alloy 78. The formation and presence of the eta phase 79 causes the hardfacing to be embrittled. Thus, the combined formation of the heat affected zone 76 and the eta phase 79 that occurs during application of the hardfacing at elevated temperature, operates to cause the hardfacing 70 to be embrittled and not display a desired combination of toughness and hardness.

Figure 6:
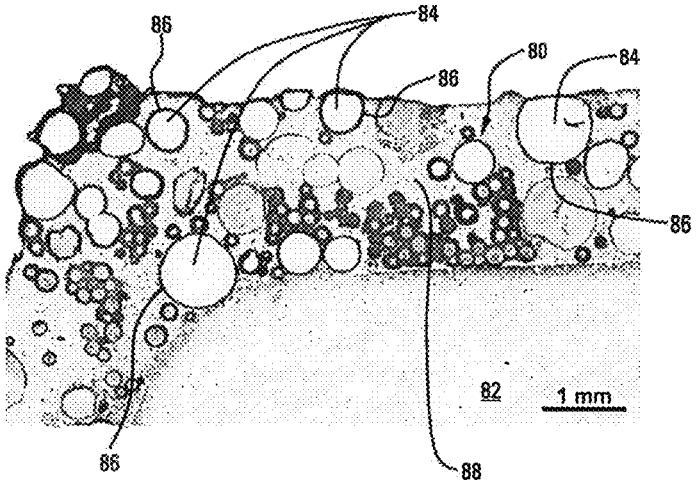
FIG. 6 is a photomicrograph image of an example premium hardfacing material composition as disclosed herein disposed on a cutting element.

FIG. 6 is a photomicrograph illustrating a hardfacing layer 80 formed from the premium hardfacing material composition as disclosed herein, on a surface of a milled tooth 82 of a drill bit (such as that illustrated in FIG. 1). The hardfacing layer 80 includes sintered carbide pellets 84 as disclosed herein encapsulated with the thermally stable material to provide a surrounding thermal barrier layer 86. As contrasted to the conventional hardfacing layer 70 illustrated in FIG. 5, the presence of the thermal barrier layer 86 in the hardfacing material composition disclosed herein is shown to operate to prevent the unwanted formation of the eta phase in the sintered carbide pellets 84 and the adjacent metallic binder alloy matrix 88 during application of the hardfacing at elevated temperature, thereby providing a hardfacing having an improved desired degree of hardness and/or toughness to thereby provide an extended service life when compared to conventional hardfacing materials.

Figure 7A:
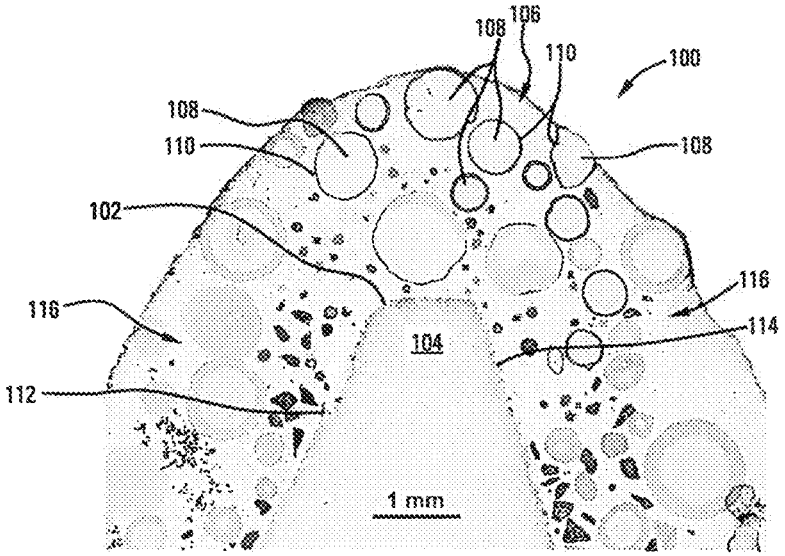
FIGS. 7A, 7B, and 7C are photomicrographs of a cutting element in the form of a milled tooth comprising different hardfaced surfaces as disclosed herein.
Figure 7B:
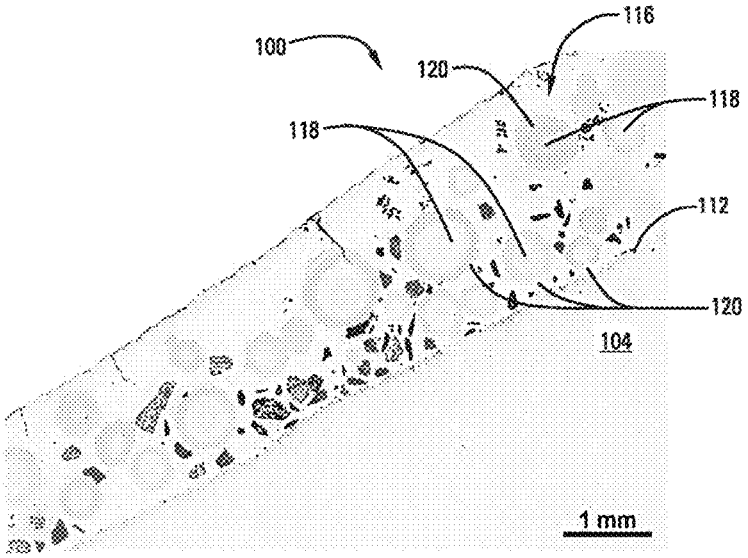
Figure 7C:
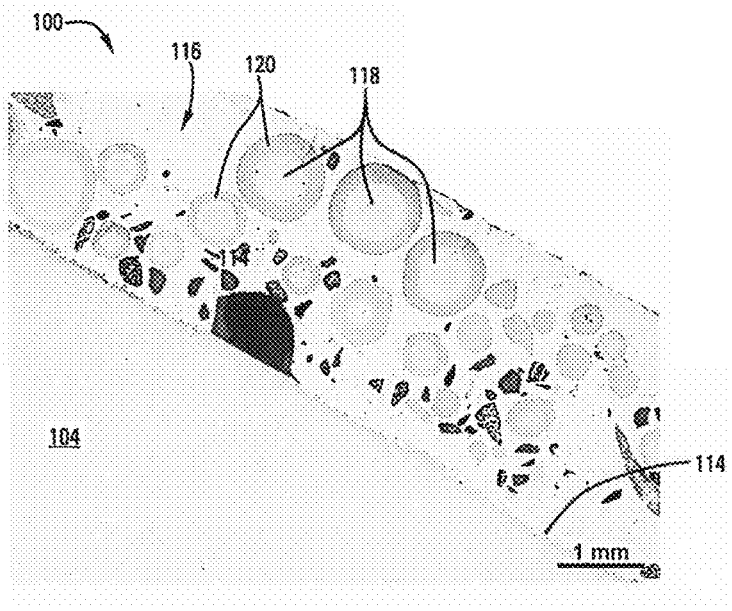

FIGS. 7A, 7B and 7C are photomicrographs different surfaces of a cutting element in the form of a milled tooth having hardfaced layers or surfaces formed from the premium hardfacing material and a different hardfacing material. FIG. 7A illustrates a hardfaced milled tooth 100, and more specifically a crest surface 102 of the milled tooth 104 comprising a hardfaced layer 106 disposed thereon that is formed from the premium hardfacing material described above and illustrated in FIG. 6. As illustrated, the hardfaced layer 106 comprises sintered carbide pellets 108 as disclosed above encapsulated with the thermally stable material to provide a surrounding thermal barrier layer 110. Also illustrated in FIG. 7A are flank surfaces 112 and 114 of the milled tooth 104 that extend from opposite sides of the 102 and that have a hardfaced layer 116 disposed thereon different from that of the crest, which is formed from a different hardfacing material having a reduced wear resistance as compared with the hardfaced layer 106.

FIGS. 7B and 7C illustrate different portions of the hardfaced milled tooth 100. FIG. 7B illustrates the flank surface 112, and FIG. 7C illustrates the flank surface 114 of the milled tooth 104 and the hardfaced layer 116 disposed thereon. The hardfaced layer 116 is not formed from the premium hardfacing material and comprises the features illustrated above in FIG. 5 such as the sintered carbide pellets 118 that are not encapsulated to include a thermal barrier and that are shown to include a heat affected zone 120 that appears as a darkened zone surrounding an outside region of the pellets 118 where the sintered full dense WC—Co structure is getting loose, Co diffuses out into the metallic binder alloy and Fe from the alloy diffuses in, ultimately resulting in the hardfaced layer having a reduced degree of wear resistance as compared to the hardfaced layer formed from the premium hardfacing material.

Thermally stable materials useful for encapsulating the hard material pellets of hardfacing compositions disclosed herein include those that are functionally capable of providing a thermal barrier to mitigate, and thereby inhibit and potentially prevent, interdiffusion between the hard material pellet and the metallic binder alloy phase. Such materials include those having melting points that are above the temperatures encountered during application of the hardfacing material, e.g., greater than about 1,650° C., and preferably greater than about 1,700° C., and/or during use of the device that is hardfaced in a particular application, e.g., as a bit used for drilling subterranean formations. Example materials useful as the thermal barrier include refractory metals, carbides of refractory metals, and combinations thereof. Such refractory metals and/or carbides of the same may include Ti, V, Cr, Zr, Nb, Mo, Ru, Rh, Hf, Ta, W, Re, Os and Ir. In example embodiment, the thermal barrier material is one formed from tungsten (W) and tungsten carbide (WC). Accordingly, thermally stable materials used to form the thermally stable barrier are free of materials having a melting temperature below about 1,650° C., which includes but is not limited to such materials as Co, Ni, Fe, Cu, combinations thereof or the like.

According to some embodiments, it is desired that the entire hard material pellet be encapsulated by the thermally stable material to provide comprehensive surface protection against unwanted interdiffusion. The thermal barrier is thus provided in the form of a layer or shell disposed around and surrounding the outside surface of the hard material pellet. The layer thickness of the thermal barrier may vary, but ideally should be of sufficient dimension to give a mechanically/thermally/chemically stable structure capable of providing the desired thermal barrier to prevent unwanted disassociation of the hard material pellets, dense enough to eliminate the diffusion path of materials such as Fe, Ni, Cu, and Co and the like in the metallic binder alloy phase, while not being so great so as to interfere with the desired hardness and wear resistant properties of the underlying hard material pellet. In an example, the thickness of the thermal barrier layer will also be a function of the material used to form the pellet and its relative size, as well as the thermal conductivity and chemical affinity of the thermally stable material with the hard material pellet.

In an example, the thermal barrier layer may have a thickness that is about 2% to 4% of that of the hard material pellet diameter. Thus, an example thermal layer as used herein may have a thickness of greater than 1 micron, in the range of from about 2 to 80 microns, from about 20 to 50 microns, and preferably about 10 to 30 microns. In certain applications such as that disclose above where the hard material pellet is 30/40 US mesh size, a thermal barrier thickness of about 10 microns may be sufficient, and where the hard material pellet is 16/20 US mesh size, a thermal barrier thickness of about 20 microns may be sufficient. These are but example thermal layer thicknesses and it is to be understood that other thickness within the ranges provided above may be used to provide a desired thermal barrier depending on the particular pellet material, thermally stable material, pellet size, composition of the metallic binder alloy phase, and end-use application. It should also be understood that in some embodiments, a fraction of the pellets may have imperfections in the encapsulation, such as holes or thin areas, where interdiffusion is not wholly prevented.

In an example, the thermal barrier material may be applied to the hard material pellet by methods that include but are not limited to electronic plating, electroless plating, chemical vapor deposition (CVD) coating plasma vapor deposition (PVD) coating, plasma coating, mechanical alloying, and by reduction reaction. Prior to coating the hard material pellets it may be useful to clean or otherwise prepare the pellets for coating so as to ensure a strong adhesion therewith. In an example where the hard material pellets are sintered WC—Co, prior to applying the thermal barrier material, e.g., in the form of W, the pellets are cleaned to remove all residues, oxides or greases with an organic solvent, ultrasonic energy, combinations thereof and the like. In an example, a CVD process may be used to deposit or grow thin films of the thermal barrier coatings upon the hard material pellets. CVD systems operate by introducing a process gas or chemical vapor into a deposition chamber in which the substrate/hard material pellets to be processed have been placed. The gaseous source chemicals pass over the substrate, are adsorbed and react on the surface of the substrate to deposit the film. Various inert carrier gases may also be used to carry a solid or liquid source into the deposition chamber in a vapor form. Typically, the substrate is heated from about 200 to 900° C., and in another example from about 600 to 800° C. to initiate the reaction for a length of time calculated to achieve the desired thermal barrier material layer thickness.

In addition to the coated sintered hard material pellets disclosed above, the hard phase of hardfacing material compositions as disclosed herein may also contain other hard materials other than the sintered pellets that may include carbides such as cast tungsten carbide, titanium carbide, titanium boride, and tungsten boride and combinations thereof. Cast tungsten carbide is a eutectic mixture of the WC and W2C compounds, as such the carbon content in cast carbide is sub-stoichiometric, (i.e., it has less carbon than the monotungsten carbide). Cast tungsten carbide is typically made by resistance heating tungsten in contact with carbon in a graphite crucible having a hole through which the resultant eutectic mixture drips. The liquid is quenched in a bath of oil and is subsequently comminuted to the desired particle size and shape. The cast tungsten carbide may be in the form of crushed or spherical particles.

In an example, the cast tungsten carbide used herein is preferably in the form of spherical particles for the purpose of providing improved impact resistance by uniform stress distribution. In an example, such additional hard material may have an average particle diameter of about 30 to 150 US mesh (90 to 600 microns), and preferably from about 60 to 120 US mesh (125 to 250 microns). Such additional hard materials in the hard material phase may be provided having a monomodal or multimodal size distribution depending on the particular desired properties and end-use application. In an example, such as that disclosed above where the hard phase pellets are provided having the multimodal size distribution of 16/20 US mesh and 30/40 US mesh, the additional hard materials in the form of spherical cast carbide have an average particle size of from about 60 to 120 US mesh (125 to 250 microns).

In an example, the amount of such additional hard materials used to form the hardfacing hard phase is less than about 50 wt % of the total weight of the hard material phase, is from about 10 to 45 wt %, between about 20 to 35 wt %, and preferably 25 to 30 wt % of the total weight of the hard material phase (wherein the hard material phase is understood to be the hard pellets and the additional hard materials). In the particular example described above where the total amount of hard pellets is approximately 70 wt %, the remaining hard materials comprise approximately 30 wt % of the total weight of the hard material phase.

In an example, such additional hard materials are not coated with the thermally stable material. Alternatively, the additional hard materials may be coated with the thermally stable material. Generally, the presence of such additional hard materials is desired as such materials display increased properties of hardness and wear resistance when compared to the sintered hard material pellets. Additionally, such additional hard materials operate to increase the packing density of the hard material phase in the hardfacing.

The metallic binder alloy phase of some embodiments of the present disclosure includes steel materials that are the same as, or similar to, those used as the metallic binder alloy in conventional hardfacing materials. In an example, the metallic binder alloy may be an iron-based binder alloy or a nickel-based binder alloy that may additionally comprise such elements as Co, Ni, Mn, P, C, Cr, Si, S, and combinations thereof depending on the particular type of material selected. The metallic binder alloy may be an iron- or nickel-containing metal alloy having a melting point that is at least 1,300° C., and more suitably at least 1,400° C. Such metallic binder alloys may include, but are not limited to, soft steels. As used herein, the soft steels is meant to include steel materials having a low carbon content, for example steel having a carbon content of less than 0.15 wt %, based on the total weight of the steel (i.e., mild steel). Examples of mild steel include, but are not limited to, AISI (American Iron and Steel Institute) 1010 (0.1 wt % C), AISI 1008 (0.08 wt % C), and AISI 1006 (0.06 wt % C) grades of steel. Such steel materials comprise at least 95 wt % iron based on the total weight of the steel.

Hardfacing material compositions as disclosed herein generally comprise a hard or carbide phase including the coated hard material pellets and the additional hard materials, and a matrix phase including the metallic binder alloy, wherein the carbide phase is dispersed within the continuous matrix phase. As used herein, the term "hard or carbide phase", is meant to include the materials which may be placed within a welding tube or which may be placed upon a welding wire, i.e., the filler. As used herein, the term "metallic binder alloy" is meant to include the matrix material which includes materials other than those in the carbide phase as described above. A welding "rod" or stick may include or be formed of a tube formed from the metallic binder alloy, e.g., of mild steel sheet, enclosing the carbide phase. The carbide phase may also include deoxidizer for the steel, flux, and a resin binder to retain the particles in the tube during welding. The hardfacing is applied by melting the rod on the surface of the tool. The steel tube melts to weld to the surface and provides the matrix for the carbide phase in the hardfacing. During application, the deoxidizer alloys with the mild steel of the tube.

In an example, hardfacing compositions as disclosed herein comprise as combined with the hard material phase other materials such as a metal capable of forming a metal carbide, an oxidizer, and a resin binder. In such combination, the hard material in the form of the pellets and other hard materials comprise from about 90 to 98 wt %, 94 to 97 wt %, and preferably 95 to 96 wt % of the total combined composition of such materials. In a particular example, wherein the hard pellets and remaining hard materials are in the example forms and amounts disclosed above, the hard material phase comprises approximately 96 wt % of the total combined composition of the hard materials as combined with metal powder, deoxidizer, and binder resin.

In an example, the metal is provided in powder form and is used for the purpose of combining with the hard materials that are not the pellets to form desired metal carbides. Metals useful in this regard include niobium, tungsten, molybdenum, tantalum, chromium, and vanadium. In an example, the metal powder is niobium, and the amount of the metal powder used is from about 0.05 to 5 wt %, 0.1 to 2, and preferably 0.2 to 0.5 wt % of the total weight of the hard materials as combined with the metal powder, deoxidizer, and resin binder.

In an example, the deoxidizer may comprise a silicomanganese composition which may be obtained from Chemalloy Company, Inc. in Bryn Mawr, Pa. A suitable silicomanganese composition may contain 65 to 68 wt % manganese, 15 to 18 wt % silicon, a maximum of 2 wt % carbon, a maximum of 0.05 wt % sulfur, a maximum of 0.35 wt % phosphorus, and a balance comprising iron. The deoxidizer may be present in a quantity of at most about 5 wt % based on the total weight of the hard phase including the metal powder, oxidizer and resin binder.

In an example, the resin binder may be in the form of a temporary resin binder such as a small amount of thermoset resin to partially hold the hard phase pellets and other hard materials in the hard material or carbide phase together so that they do not shift during application, e.g., welding. The resin binder may be present in a quantity of at most about 1 wt % based on the total weight of the hard materials including the metal powder, deoxidizer, and resin binder.

Hardfacing material compositions as disclosed herein comprise the hard material phase (including the coated pellets and additional hard materials, metal powder, deoxidizer, and resin) as combined with the metallic binder alloy for applying to a desired metallic substrate. Hardfacing material compositions as disclosed herein do not include polycrystalline diamond. In an example, such hard material phase comprises at least about 50 wt %, from about 55 to 80 wt %, and preferably greater than about 65 wt % of the total weight of the hard material phase and the metallic binder alloy based on the total weight of the hard material phase and metallic binder alloy. In such example, the metallic binder alloy is optionally present in the remaining amount of less than about 50 wt %, from about 20 to 45 wt %, and preferably about less than about 35 wt %. In a particular example, the hardfacing composition comprises approximately 67 wt % hard material phase, and approximately 33 wt % metallic binder alloy.

Hardfacing material compositions as disclosed herein may be applied as the premium hardfacing layer to the desired metallic substrate, e.g., a drill bit body, cone, and/or teeth, using processes well known in the art such as by atomic hydrogen welding. Another process is oxyacetylene welding. Other processes include plasma transferred arc ("PTA"), gas tungsten arc, shield metal arc processes, laser cladding, and other thermal deposition processes. In oxyacetylene welding, for example, the hardfacing material is typically supplied in the form of a tube or hollow rod ("a welding tube"), which is filled with hard phase composition and wherein the tube is often made of steel (iron) or similar metal (e.g., nickel and cobalt) which can act as a binder when the rod and its granular contents are heated.

The tube thickness is selected so that its metal forms a selected fraction of the total composition of the hardfacing material as applied to the metallic surface, e.g., drill bit and/or teeth. In another embodiment, the metallic binder alloy may be in the form of a wire, e.g., a welding wire and the hardfacing materials are coated on the wire using resin binders. With a PTA welding process, the hardfacing materials may be supplied in the form of a welding tube, a welding wire, or powder, although the powder form is preferred.

Other methods and techniques for applying both the premium hardfacing material composition as disclosed herein and the conventional or other relatively lower wear resistant hardfacing materials are known in the art and are omitted here for the sake of clarity. It should be noted that while oxyacetylene welding is the preferred method of applying premium hardfacing material compositions as disclosed herein, any suitable method may be employed.

A feature of such example premium hardfacing material compositions as disclosed herein is the use of sintered hard material pellets and the encapsulation of the same by a thermally stable material that provides a surrounding thermal barrier thereon to protect such hard material pellets from the unwanted interdiffusion that is known to occur in conventional hardfacing materials at high temperatures associated with application of the hardfacing, which interdiffusion otherwise operates to embrittle and reduce combined toughness and hardness properties of the hardfacing by the unwanted formation of a heat affected region and by the formation of an eta phase as discussed above. Accordingly, such premium hardfacing material compositions as disclosed herein are specifically engineered to substantially eliminate such interdiffusion between the hard phase pellets and surrounding metallic binder alloy, thereby ensuring that the desired level of toughness and hardness remains after the hardfacing is applied, thereby providing enhanced service life of the metallic surface provided by the composition once applied.

Hardfacing material compositions as disclosed herein (e.g., the hardfacing material construction as disclosed above and illustrated in FIG. 6) were tested for wear and impact against conventional hardfacing materials (e.g., with the hardfacing material discussed above and illustrated in FIG. 5), and the results were compared. Specifically, a high stress wear test was conducted in accordance with ASTM B611, and the test results demonstrated that the hardfacing material composition as disclosed herein provided a wear number that was approximately 27% greater than that of the conventional hardfacing material. A low stress wear test was also conducted in accordance with ASTM G65, and the test results demonstrated that the hardfacing material composition as disclosed herein provided a volume loss that was approximately 9% less than that of the conventional hardfacing material. Finally, a combined wear and impact test was conducted, wherein the two different hardfacing materials were subjected to both wear and impact conditions, for an accumulated period of time of 7 hours and the accumulated weight loss was measured every hour. The results demonstrated the following comparative weight loss differences: after 1 hour a 60% lower weight loss; after 2 hours a 71% lower weight loss; after 3 hours a 70% lower weight loss; after 4 hours a 76% lower weight loss; after 5 hours a 71% lower weight loss; after 6 hours a 70% lower weight loss; and after 7 hours a 64% lower weight loss as compared to the conventional hardfacing materials. Accordingly, these test results operate to confirm that such premium hardfacing material compositions as disclosed herein provide improved properties of wear resistance/hardness and toughness (as measured in terms of wear number, weight loss, and cumulative weight loss) when compared to conventional hardfacing materials.

Referring back to FIG. 3, is desired that such premium hardfacing materials be used to provide a hardfaced layer or surface on a portion of the cutting element surface. As illustrated in FIG. 3, in an example where the cutting element is a steel milled tooth 40, such hardfaced surface 56 formed from the premium hardfacing material is disposed onto the crest 44 of the tooth. In such example, the remaining surfaces of the tooth 40 may or may not be covered with another material. In an example, one or more of the remaining surfaces of the tooth 40, e.g., one or both of the flanks surfaces and/or one or more of the axial end surfaces may comprise a comprise a hardfaced layer 58 disposed therein that is formed from a different material may or may not be a hardfacing material and that has a wear resistance less than that of the hardfaced layer 56 formed from the premium hardfacing material described above.

In example, the hardfaced layer or surface 56 may extend to cover an adjacent region of one or both of the flank surfaces, and optionally an adjacent region of one or both of the axial end surfaces. In one example, only the crest surface of the steel milled tooth is hardfaced with the premium hardfacing material, and the remaining flank and axial end surfaces are hardfaced with conventional lower wear resistance hardfacing material. Optionally, only selected remaining surfaces of the steel milled tooth may be hardfaced with the conventional hardfacing, and the other of the remaining surfaces may not be hardfaced or may be covered with some other type of material having a lower wear resistance than that of the premium hardfacing material.

In an example, again referring to a steel milled tooth bit, the surfaces hardfaced with the premium hardfacing material may include an adjacent region of one or both of the flank surfaces. In such example, such adjacent region may comprise from about 2% to about 50%, 10% to 40%, and 20% to 30% of the total surface area of one or both of the flank surfaces as measured from an intersection with the crest surface downwardly towards a base of the flank surface. In addition to or in place of the flank surfaces, the premium hardfacing material may include an adjacent region of one or both of the axial end surfaces. In such example, such adjacent region may comprise from about 2% to about 50%, 10% to 40%, and 20% to 30% of the total surface area of one or both of the axial end surfaces as measured from an intersection with the crest surface downwardly towards a base of the axial end surface. Whether such flank and/or axial end surfaces are hardfaced with the premium hardfacing material will depend on the particular wear performance characteristics needed by the milled tooth as determined for a particular end-use application.

In an example, the thickness of the premium hardfaced surface is the same as that of the remaining hardfaced surfaces of the cutting element comprising the relatively lower wear resistance hardfacing material. Depending on the particular embodiment and/or particular end-use application, the premium hardfaced layer may have a thickness that is greater than the remaining hardfaced surfaces of the cutting element comprising the relatively lower wear resistance hardfacing material. In an example, the thickness of the hardfaced surface or layer may be greater than about 2 mm, from about 2.3 to 5 mm, and from about 3.5 to 4.75 mm.

A feature of using such premium hardfacing material only along the surfaces of the cutting element subjected to a higher level of wear loss during use, and using the conventional hardfacing material having relatively lower wear resistance to provide hardfacing on the other surfaces, is that it eliminates the need to use higher thickness layers along the different surfaces to gain the optimized wear performance desired, as the increased wear performance is provided by the increased wear resistance of the premium hardfacing material itself. This operates to both make the process of applying the hardfacing materials to the different surfaces of the cutting element easier, as the thickness is the same, and also operates to reduce material costs because the relatively more expensive premium hardfacing material is only being used where it is needed most, and not being used to provide a hardfaced surface over the entire cutting element surface.

Other or different hardfacing materials useful for forming the relatively lower wear resistant hardfaced layer on cutting elements as disclosed here my include those known in the art, e.g., that typically comprises from about 30 to 40 wt % steel, and include carbide pellets and/or particles having a particle size in the range from about 200 to 1,000 microns. Examples of conventional materials used for forming hardfaced layers can be found in U.S. Pat. Nos. 4,944,774; 5,663,512; 5,921,330; and 9,353,578. Additionally, other or different hardfacing material useful for forming the relatively lower wear resistant hardfaced layer or surface may be formed from the hardfacing material disclosed above having the thermally insulating barrier but with differences in material content or other feature(s), thereby providing a relatively reduced degree of wear resistance as contrasted to the premium hardfacing material as disclosed above.

Figure 8:
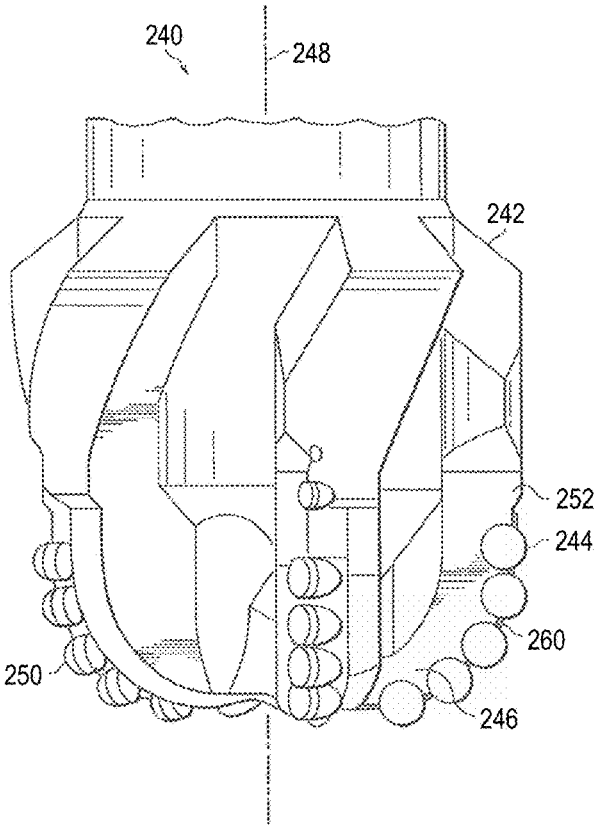
FIG. 8 is a perspective view of a fixed cutter drill bit.

While cutting elements comprising a composite of premium and conventional hardfacing material compositions as disclosed herein have been described and illustrated as being used with a particular example device and tool, it is to be understood that such approach of using a composite of such different hardfacing materials to address the different wear issues as disclosed here may be used in conjunction with any type of tool or equipment where improved or optimized wear resistance over that of the underlying substrate material is desired. Examples of such other types of tools and equipment include and are not limited to blades or cutting faces of mills (e.g., lead mills, window mills, taper mills, dress mills, follow mills, watermelon mills, junk mills, section mills, and the like), hole openers, underreamers, and stabilizers. The composite hardfacing material composition as disclosed herein may also be applied to slips or gripping elements of tools such as anchors or downhole tractors. Composite hardfacing material constructions as disclosed herein may also be applied to tools used to re-grind downhole debris or internally on impact surfaces within various tools (e.g., jars, vibration tools, hammer bits, and the like). Composite hardfacing material compositions may be applied as hardbanding on tool joints or upsets of drill pipe, drill collars, transition or heavy weight drill pipe, stabilizers, underreamers, hole openers, milling tools, fishing tools, jars and impact tools, vibration tools, bypass valves, measurement-while-drilling tools, logging-while-drilling tools, circulation valves, release tools, among others. These are but a few examples of the types of tools and equipment that composite hardfacing material constructions may be used with and it is understood that all such uses are intended to be within the scope of this disclosure. Indeed, in other embodiments, premium hardfacing compositions according to the present disclosure may be used in connection with a fixed cutter drill bit. FIG. 8, for instance, illustrates a fixed cutter drill bit 240 including a bit body 242 having a cutting structure that includes at least one blade and at least one cutting element 244 on the blade. The cutting elements 244 may include polycrystalline diamond (PCD) compacts. Typically, the bit body 242 is formed of steel or a matrix material. Example matrix materials include powdered tungsten carbide infiltrated with a binder alloy within a suitable mold.

The bit body 242 is formed with at least one blade 246, which extends generally outwardly, away from a central longitudinal axis 248 of the drill bit 240. In this example, the bit body includes one or more layers of hardfacing 260 for abrasion and/or erosion resistance. The cutting elements 244 are on the blade 246, and the blades 246 include at least one pocket 250 adapted to receive the cutting element 244. The additional area of the blade 246 that contacts the wall of the wellbore is the gage area 252. The number of blades 246 and/or cutting elements 244 are related to a variety of factors, including the type of formation to be drilled, and can thus be varied to meet particular drilling requirements. The one or more layers of hardfacing 260 may be deposited on any exterior surface of the fixed cutter drill bit 240. In some example embodiments, the hardfaced layer is applied to at least a portion of a blade on the fixed cutter drill bit, which may include at least a portion of the cutter pocket, or a portion of the blade around the cutter pocket (e.g., a face surface, or a formation facing downhole surface).

Although only a few example embodiments of cutting elements comprising composite hardfacing material constructions as disclosed herein have been described in detail above, those skilled in the art will readily appreciate that many modifications are possible in the example embodiments without materially departing from the concepts as disclosed herein. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke "means for" or other functional claiming for any limitations of any of the claims herein, except for those in which the claim expressly uses the words "means for" together with an associated function.

What is claimed is:

1. A cutting element for use with a bit for drilling subterranean formations, the cutting element comprising:

a first surface disposed along an uppermost portion of the cutting element; and second surfaces extending downwardly away from the first surface;

wherein the first surface comprising a hardfaced layer disposed therein formed from a hardfacing material, wherein the hardfaced layer has a wear resistance that is at least 10% greater than the remaining cutting element surfaces not comprising the hardfaced layer;

wherein the hardfaced layer is formed from a hardfacing composition comprising:

a plurality of hard material phases comprising pellets dispersed in a continuous metallic alloy binder phase; and a thermally stable material layer encapsulating the pellets and interposed between and in contact with both the pellets and the continuous metallic alloy binder phase, wherein the thermally stable material layer is formed from a material selected from the group consisting of refractory metals, carbides of refractory metals, and combinations thereof.

2. The cutting element as recited in claim 1, wherein a partial region of one or more of the second surfaces extending adjacent from the first surface comprises the hardfaced layer of the first surface.

3. The cutting element as recited in claim 1, wherein the cutting element comprises a milled tooth, the first surface comprises a crest, and the second surfaces comprise first and second flanks that extend downwardly from opposed edges of the crest.

4. The cutting element as recited in claim 3, wherein one or both of the first and second flanks comprise a different hardfaced layer disposed thereon having a wear resistance less than the hardfaced layer disposed on the crest.

5. The cutting element as recited in claim 4, wherein the milled tooth further comprises axial edge surfaces opposed from one another and extending between the first and second flanks, and wherein one or both of the axial edge surfaces comprise a different hardfaced layer disposed thereon having a wear resistance less than the hardfaced layer of the crest.

6. The cutting element as recited in claim 4, wherein the thickness of the hardfaced layer on the crest is the same as the thickness of the different hardfaced layer on one or both of the first and second flanks.

7. The cutting element as recited in claim 4, wherein the thickness of the hardfaced layer on the crest is greater than the thickness of the different hardfaced layer on one or both of the first and second flanks.

8. The cutting element as recited in claim 3, wherein the hardfaced layer is disposed on a crest of the cutting element, the hard material phase comprises sintered WC—Co pellets, and wherein the continuous metallic alloy binder phase comprises an iron-or nickel-based metal.

9. A roller cone for use with a bit for drilling subterranean formations, the roller cone comprising:

a milled tooth having:

a crest surface disposed along an uppermost portion of the tooth and having a first hardfaced layer disposed thereon formed from a first hardfacing material; and first and second flank surfaces extending from opposite edges of the crest surface in a downward direction towards a base of the tooth, wherein one or more of the first and second flank surfaces comprises a second hardfaced layer disposed thereon formed from a second hardfacing material;

wherein the first hardfacing layer formed from the first hardfacing material has a wear resistance that is at least 10% greater than the wear resistance of the hardfaced layer formed from the second hardfacing material;

wherein the first hardfacing material comprises:

a plurality of hard material phases comprising pellets dispersed in a continuous metallic alloy binder phase; and a thermally stable material layer encapsulating the pellets and interposed between and in contact with both the pellets and the continuous metallic alloy binder phase, wherein the thermally stable material layer is formed from a material selected from the group consisting of refractory metals, carbides of refractory metals, and combinations thereof.

10. The roller cone as recited in claim 9, wherein both the first hardfaced layer and the second hardfaced layer have substantially the same thickness.

11. The roller cone as recited in claim 9, wherein the first hardfacing layer formed from the first hardfacing material has a wear resistance that is at least 20% greater than the wear resistance of the second hardfaced layer formed from the second hardfacing material.

12. The roller cone as recited in claim 9, wherein the first and second hardfacing materials each comprise a hard phase material comprising carbide and a metallic binder phase.

13. The roller cone as recited in claim 9, wherein a partial region of at least one of the first and second flank surfaces adjacent the crest surface comprise the first hardfaced layer formed from the first hardfacing material.

14. The roller cone as recited in claim 13, wherein the partial region comprises at least 10% of the total surface area of the at least one of the first and second flank surfaces.

15. The roller cone as recited in claim 9, wherein the hard material phase comprises sintered WC—Co pellets, and wherein the continuous metallic alloy binder phase comprises an iron-or nickel-based metal.

16. The roller cone as recited in claim 9, wherein the refractory metals are selected from the group consisting of Ti, V, Cr, Zr, Nb, Mo, Ru, Rh, Hf, Ta, W, Re, Os, and Ir.

17. The roller cone as recited in claim 9, wherein the carbides of refractory metals include those selected the group consisting of Ti, V, Cr, Zr, Nb, Mo, Ru, Rh, Hf, Ta, W, Re, Os, and Ir.

18. The roller cone as recited in claim 9, wherein the thermally stable material layer comprises W.

19. The roller cone as recited in claim 9, wherein the material used to form the thermally stable material layer has a melting temperature of greater than about 1,650° C.

20. A bit for drilling earthen formations comprising:

a body and a number of cones rotatably disposed on the body, the cones comprising a number of teeth projecting therefrom, wherein at the least one of the teeth comprises:

a crest surface disposed along an uppermost portion of the tooth and having a first hardfaced layer disposed thereon formed from a first hardfacing material; and first and second flank surfaces extending from opposite edges of the crest surface in a downward direction towards a base of the tooth, wherein one or more of the first and second flank surfaces comprises a second hardfaced layer disposed thereon formed from a second hardfacing material;

wherein the first hardfacing layer formed from the first hardfacing material has a wear resistance that is at least 20% greater than the wear resistance of the second hardfaced layer formed from the second hardfacing material, and wherein each hardfaced layer has substantially the same thickness, wherein the first hardfacing material comprises:

a plurality of hard material phases comprising pellets dispersed in a continuous metallic alloy binder phase; and a thermally stable material layer encapsulating the pellets and interposed between and in contact with both the pellets and the continuous metallic alloy binder phase, wherein the thermally stable material layer is formed from a material selected from the group consisting of refractory metals, carbides of refractory metals, and combinations thereof.

* * * * *